US008578664B2

(12) United States Patent
Wrightman

(10) Patent No.: US 8,578,664 B2
(45) Date of Patent: Nov. 12, 2013

(54) ROOF TO POST ADJUSTABLE HOLD DOWN DEVICE

(75) Inventor: Robert A. Wrightman, Bracebridge (CA)

(73) Assignee: Robert A. Wrightman, Bracebridge (CA)

( * ) Notice: Subject to any disclaimer, the term of this patent is extended or adjusted under 35 U.S.C. 154(b) by 631 days.

(21) Appl. No.: 12/624,064

(22) Filed: Nov. 23, 2009

(65) Prior Publication Data

US 2010/0129147 A1 May 27, 2010

Related U.S. Application Data

(60) Provisional application No. 61/193,375, filed on Nov. 21, 2008.

(51) Int. Cl.
*E04H 12/00* (2006.01)

(52) U.S. Cl.
USPC ..... 52/126.1; 52/23

(58) Field of Classification Search
USPC ..... 52/126.1, 126.3, 126.4, 126.7, 167.1, 52/92.2, 93.1, 291, 293.3, 23, 223.13, 52/223.14, 741.1, 233; 411/205, 433, 332, 411/432, 536; 403/343, 111, 146, 293
See application file for complete search history.

(56) References Cited

U.S. PATENT DOCUMENTS

| | | | | |
|---|---|---|---|---|
| 5,081,811 | A | 1/1992 | Sasaki | |
| 5,570,549 | A * | 11/1996 | Lung et al. | 52/295 |
| 5,791,096 | A * | 8/1998 | Chen | 52/126.6 |
| 5,862,635 | A * | 1/1999 | Linse et al. | 52/126.6 |
| 5,904,009 | A * | 5/1999 | Huang | 52/126.6 |
| 6,519,902 | B1 * | 2/2003 | Scissom | 52/126.4 |
| 6,637,161 | B1 * | 10/2003 | Buchalter et al. | 52/126.6 |
| 6,904,728 | B2 | 6/2005 | Stutts | |
| 6,941,710 | B2 * | 9/2005 | Eden | 52/170 |
| 2009/0133345 | A1 | 5/2009 | Wrightman | |

* cited by examiner

*Primary Examiner* — William Gilbert
*Assistant Examiner* — Beth Stephan
(74) *Attorney, Agent, or Firm* — John R. S. Orange; Blake, Cassels & Graydon LLP

(57) ABSTRACT

A connector to connect a pair of components of a building and transfer a load from one to the other. The connector comprising a pair of members, each to be connected to a respective one of the components, and an adjustable abutment acting between the members to inhibit relative movement between the members in one direction. The ratchet mechanism acting between the members to permit movement in the one direction and to inhibit relative movement in an opposite direction, whereby adjustment of the abutment to cause relative movements in the one direction is accommodated by the ratchet mechanism.

17 Claims, 4 Drawing Sheets

ROOF TO POST ADJUSTABLE HOLD DOWN DEVICE

CROSS REFERENCE TO RELATED APPLICATIONS

This application claims priority from U.S. Provisional Patent Application No. 61/193,375 filed Nov. 21, 2008, the contents of which are being incorporated herein by reference.

FIELD OF THE INVENTION

The present invention relates to a connector for use in building construction to permit relative movement between two components.

SUMMARY OF THE INVENTION

It is well known to use connectors to join components used in a building. These connectors may be as simple as plates extending across the joint between a pair of components or may be more complex so as to permit alignment and adjustment between the components. One area in which connectors are used is in the connection between a post and beam. Typically, such a connector will consist of a plate secured to the beam with a threaded rod extending from the plate into a bore in the end of the post. A nut on the threaded rod bears against the end face of the post and rotation of the nut can adjust the relative spacing between the end of the post and the beam. This is particularly useful to ensure that the post is properly supporting the beam in a horizontal manner and also to allow subsequent adjustment to accommodate building movement.

Movement of the building arises typically through the shrinkage of the wood used in the construction. Relatively small changes in the dimensional lumber can accumulate to represent a relatively large change in overall dimensions and, if this is not accommodated, the beam may not be properly supported or may not remain horizontal. This is particularly acute in log home construction using logs as the basic wall material as the logs are machined and assembled in a green state. Subsequent drying of the logs produces a significant change in the overall vertical height of the wall.

Many buildings also incorporate a porch or similar overhanging structure in which the roof structure projects beyond the walls and has its outer ends supported on a post. The roof structure is designed on the assumption that there are multiple points of support, that is the walls and the posts, and to maintain the integrity of the roof, it is therefore necessary to ensure that the top of the post and the walls remain aligned. Shrinkage of the wall, particularly where a log wall is used, can therefore impose significant bending loads on the roof that, in extreme cases, may result in failure of the roof.

Normally, the connection between the post and the roof structure is provided by a connector of the type described above so that the spacing between the end of the post and the roof can be adjusted as the building dries. This arrangement is satisfactory for normal static loads but does not take into account dynamic loads that may be imposed on the roof, such as by wind loads. In extreme weather conditions, the loads imposed on the roof, particularly on an overhanging roof, can create a net uplift on the roof structure. In this condition, the connection between the post and beam cannot provide any assistance to resist the uplift. The entire load is placed on the connection between the walls and the roof structure and failure of this connection can result in damage to the roof or loss of the roof in extreme circumstances.

Attempts have been made to provide a connector that will resist vertical loads in both directions while still accommodating limited vertical adjustment. One such device is that sold by Simpson Strongtie under model identification PPRC in which the threaded rod is received in a flange that is itself secured to a plate. The flange however has to be manufactured so as to allow rotation relative to the post to accommodate height adjustment but at the same time be retained by the plate. As such, there is significant overlap between the flange and the plate so that a very high torque is required when adjustments are to be made. These devices are suitable for relatively light loads only.

It is therefore an object to the present invention to provide a connector that permits adjustment between a pair of components whilst providing resistance to loads in opposite directions.

In general terms, the present invention provides a connector having a pair of members, one of which is to be secured to one component and the other of which is to be secured to the other component. An adjustable abutment acts between the two members to inhibit movement in one direction. A ratchet mechanism is also positioned between the two members that allows rotation in the one direction but inhibits it in the opposition direction.

Preferably, the ratchet mechanism includes a collet that engages the outer surface of a threaded rod and forms one of the members. The collet abuts an inclined face so that relative movement of the threaded rod in one direction causes the collet to engage the threaded rod and inhibit such movement. Preferably, also, the adjustment is a nut on the threaded rod that controls the relative disposition between the two members.

The connector may be used to connect a post and a beam structure and may be used at either end of the post. The post may be located within the building, such as to secure an upper floor or may be located outside the building, such as to support an overhanging porch.

Preferably the collet is spring biased into engagement with the threaded rod.

BRIEF DESCRIPTION OF THE DRAWINGS

Embodiments of the invention will now be described by way of example only with references to the accompanying drawings in which.

DETAILED DESCRIPTION OF THE INVENTION

Figure 1:
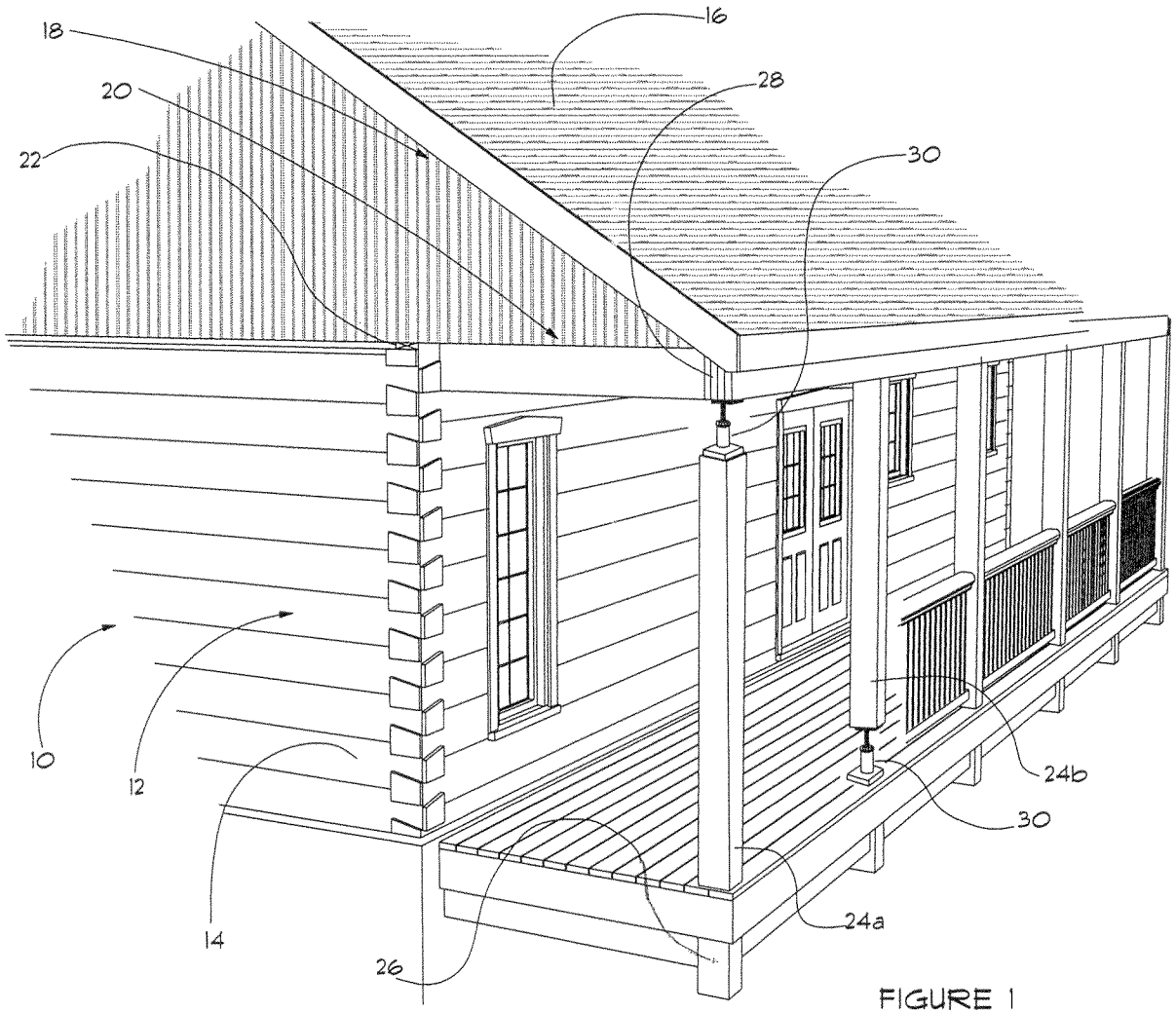
FIG. 1 is schematic representation of a building.

Referring therefore to FIG. 1, a building, generally indicated 10, has walls 12 constructed from logs 14 that support a roof structure 16. The roof structure 16 has trusses 18 that include a lower chord 20 supported on a top plate 22 interposed between the uppermost log 14 and the chord 20.

The chord 20 extends beyond the wall 12 to provide a roof structure for a porch and is supported by posts 24. The posts 24 extend from a foundation 26 to a beam 28 that extends the length of the roof 16. It will be appreciated that the number of posts will generally be less than the number of trusses 18 and that the beam 28 therefore spans several trusses 18 between the posts 24.

A connector 30 is located on each of the posts 24, either at the upper end adjacent to the beam 28, as shown at post 24*a* in FIG. 1, or alternatively at the lower end of the post, as shown at post 24*b*, in FIG. 1. Each connector is similar and simply inverted according to its disposition. For ease of reference, the connector 30 associated with the post 24*a* will initially be described with reference to FIGS. 2 and 3.

Figure 2:
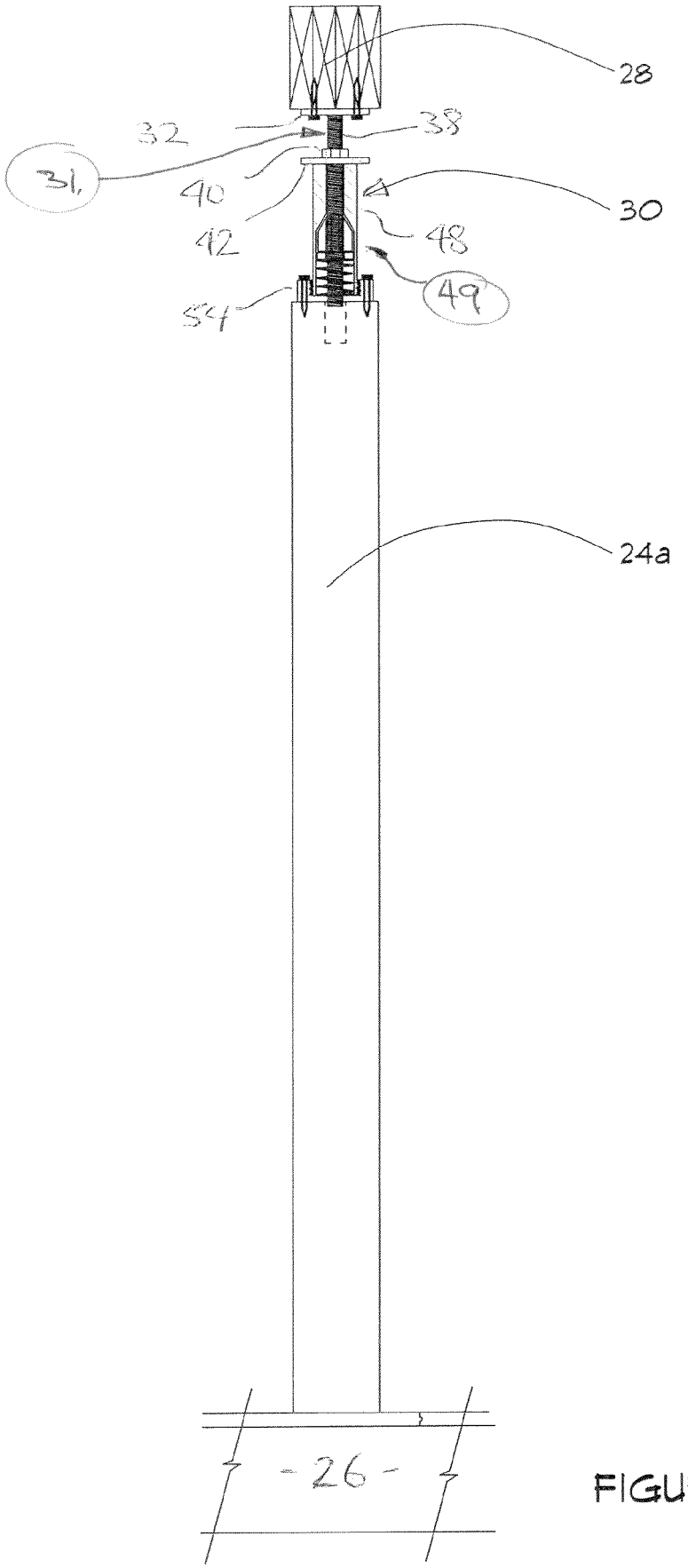
FIG. 2 is a enlarged view of a portion of the building shown in FIG. 1.
Figure 3:
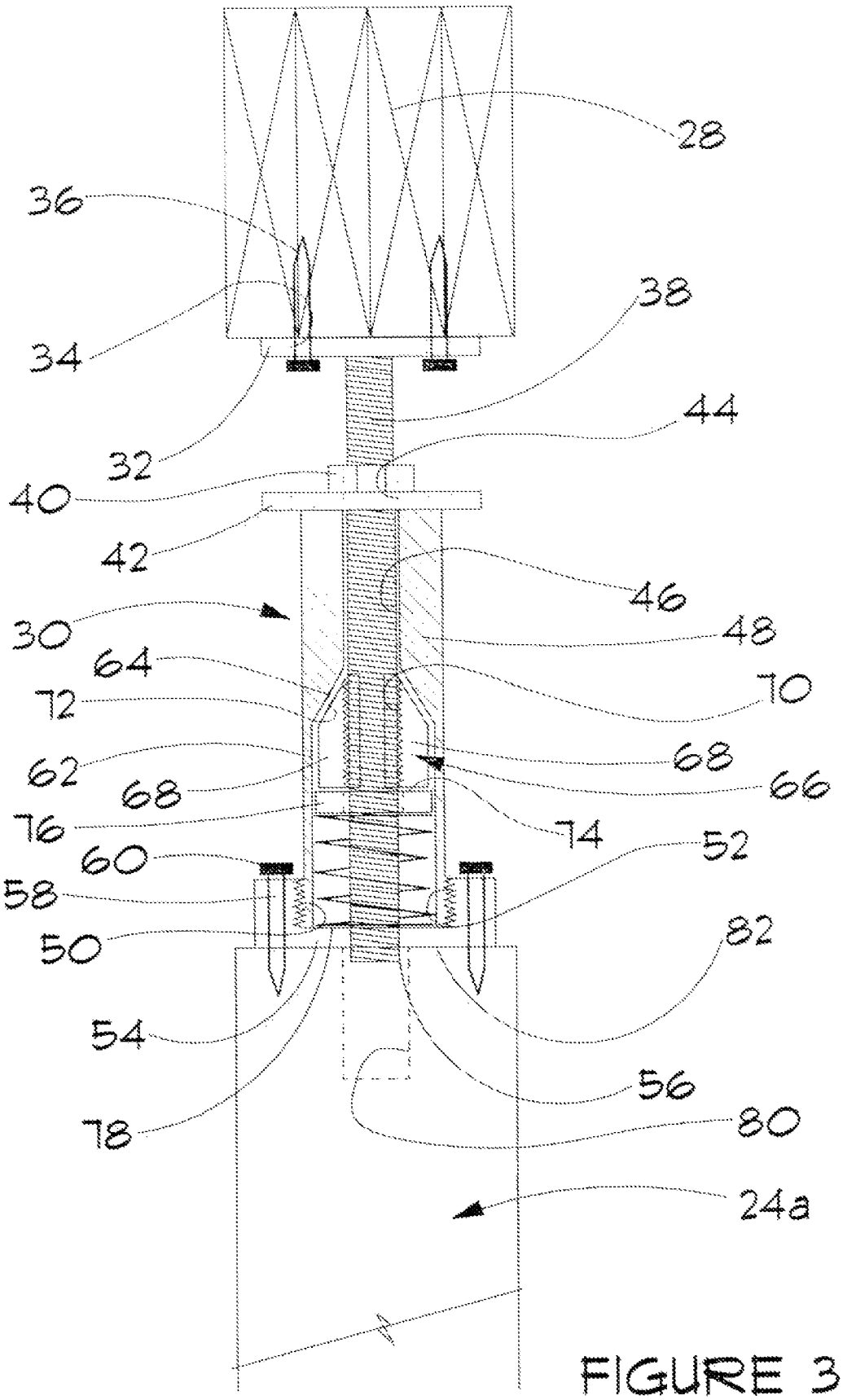
FIG. 3 is an enlarged view of FIG. 2.

Referring therefore to FIGS. 2 and 3, the connector 30 includes a first member 31 with a plate 32 having holes 34 to receive fasteners 36. Typically, the plate 32 is square and a hole 34 is located adjacent to each corner. A threaded rod 38 is welded to the plate 32 to project to one side of the plate. The threaded rod 38 can be either a fine or a coarse threaded rod and carries a nut 40 that acts as an adjustable abutment. A washer 42 has a central hole 44 through which the rod 38 can pass freely. The position of the washer 42 on the rod 38 is therefore controlled by the nut 40 which can be rotated on the threaded rod 38 to adjust the axial position of the nut 40 relative to the plate 32.

The rod 38 is received in a central bore 46 of a barrel 48 that forms a secured member 49. The barrel 48 has an external thread 50 at one end which is received in a threaded counter bore 52 of an end plate 54. The end plate 54 has a central hole 56 through which the rod 38 can pass freely and has holes 58 to receive fasteners 60.

The barrel 48 is counterbored to provide a internal chamber 62 continuing from the bore 56 and receiving the threaded rod 38. End wall 64 of the chamber 62 is conical to provide end surfaces of the chamber 62 that are inclined to the axis of the bore 46.

A ratchet mechanism located in the chamber 62 and includes a collet 66 with a pair of jaws 68 having inner part cylindrical faces 70 that are complimentary to the outer surface of the rod 38. The jaws 68 each have inclined leading edges 72 at one end that are complimentary to the inclined face 64 of the chamber 62. The opposite end of the jaws 68 is a radial face 74 to bear against a retainer washer 76. The washer 76 is freely slidable on the threaded rod 38 and is biased into engagement with the jaws 68 by a spring 78. The spring 78 acts between the retainer washer 76 and the plate 54 and is retained captive within the chamber 62.

To install the connector 30, a bore 80 is drilled in the end face 82 of the post 24*a*. The bore 80 provides a clearance for the threaded rod 38 and extends a sufficient distance into the post 24*a* to accommodate the rod 38 over the extent of travel anticipated. The connector 30 is assembled so that barrel 48 is threaded on to the end plate 54 with the collet 66, spring 78 and retainer washer 76 assembled within the chamber 62 and the end plate 54 then secured to the end face 82 of the post 24*a* with the fasteners 60. The rod 38 may then be inserted into the central bore 46 with the rod 38 engaging the jaws 68 to move them away from the inclined surface 64 and increase that spacing to allow the threaded rod 38 to pass between the jaws 66. The movement is accommodated by the spring 78. With the rod 38 inserted, the post 24*a* may be positioned relative to the beam 28.

Once the post 24*a* is positioned vertically, the nominal length of the connector 30 can be adjusted by rotating the rod 38 so that it is threaded out of the jaws 68. Preferably the inner surfaces 70 are formed with a complimentary thread so that rotation of the rod 38 will cause axial adjustment relative to the barrel. During this assembly, the nut 40 is positioned adjacent to the plate 32 so as not to interfere with installation of the post 24*a* in the desired position.

With the plate 32 secured against the beam 28, the fasteners 36 are inserted and the nut 40 threaded down the rod 38 to bring the washer 42 into abutment with the barrel 48. In this position, the post 24*a* securely supports the beam 28 and relative vertical movement of the beam 28 toward the post 24*a* is inhibited by the nut 40 on the rod 38. At the same time, the jaws 68 are thus held in engagement with the inclined surface 64 so that the jaws 68 engage the surface of the rod 38 by virtue of the spring 78. The opposite end of the post 24*a* is secured to the foundation 26 by a conventional fixed fastener to prevent vertical movement.

In the event that an upward vertical load is applied to the beam, for example due to wind loading, the rod 38 will attempt to move vertically out of the barrel 48. The jaws 68 are carried with the rod 38 and by virtue of the inclined surfaces 64 are forced into engagement with the rod 38 to inhibit any relative movement between the rod 38 and the barrel 48. A secure connection between the beam 28 and the post 24*a* is thus provided.

When it is necessary to reduce the relative vertical spacing between the beam 28 and the post 24*a* due to shrinkage of the walls 12, the nut 40 is rotated to move it along the threaded rod 38 toward the beam 28. The rotation permits the rod 38 to move relative to the barrel 48 into the bore 80 and carries the jaws 68 away from the inclined surface 64. The jaws 68 spread within the chamber 62 allowing the threaded rod 38 to pass between the jaws 68 in an axial direction. The nut 40 therefore governs the relative spacing between the beam 28 and the post 24*a* and may be used to ensure that the lower chord 20 of the truss 18 is properly supported on the wall 14 and the post 24. Any upward vertical movement caused by reversed loading of the roof will again cause the jaws 68 to engage the rod 38 and inhibit such movement.

It will be seen therefore that by providing the ratchet connection between the rod 38 and the post 24 by the spring loaded collet, so that relative movement is permitted in one direction but inhibited in the opposite, vertical adjustment between the beam and the post can readily be accommodated but at the same time, relative movement in the opposite direction is inhibited.

Figure 4:
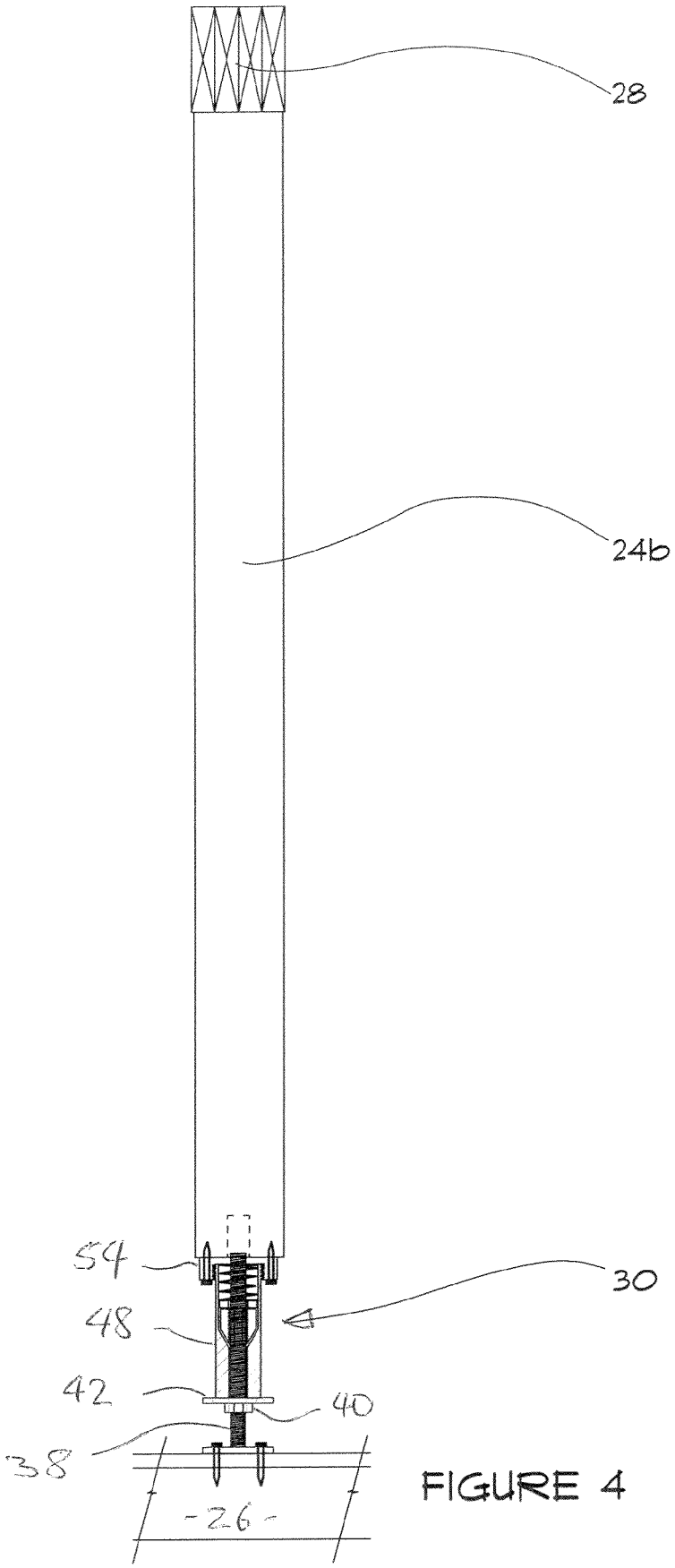
FIG. 4 is a view similar to FIG. 2 of an alternative configuration.

As indicated in FIGS. 1 and 4, the connector 30 may similarly be used at the opposite end of the post such that the plate 54 is secured to the lower end face of the post 24*b* and the opposite end face of the post 24*b* connected directly to the beam 28. In this arrangement, the plate 32 is secured to the foundation 26 and adjustment between the post 24*b* and the beam 28 accomplished as described above. Again, the connector 30 is effective to resist reverse loading on the roof whilst permitting proper adjustment to maintain alignment between the beam 28 and the walls 14.

The connector 30 has been described above in the context of securing an external over hanging roof structure. It will of course be apparent that similar connections can be used within the structure of a building to connect a supporting beam to a foundation or other structure and accommodate vertical loading. The connector 30 is able to resist the reversed loadings induced by high winds passing over the roof while still maintaining the functionality to permit adjustment of the relative alignment between the different building components. The connector may therefore be used in a basement to support a beam in the main floor of the building, or could be used in an upper floor within a wall structure to connect a roof structure to an internal support beam.

What is claimed is:

1. A connector to connect a pair of components of a building and transfer a load from one to the other, said connector comprising a pair of members, each to be connected to a respective one of the components, an adjustable abutment acting between said members to inhibit relative movement between said members in one direction and a ratchet mechanism acting between said members to permit movement in said one direction and to inhibit relative movement in an opposite direction, whereby adjustment of said abutment to cause relative movement in said one direction is accommodated by said ratchet mechanism.

2. A connector according to claim 1 wherein one of said members is a rod and the other is a barrel having an opening to receive said rod, and said adjustable abutment acts between said barrel and said rod.

3. A connector according to claim 2 wherein said rod is threaded and said adjustable abutment is a nut threaded on said rod.

4. A connector according to claim 3 wherein said nut bears against an end face of said barrel to inhibit movement of said rod in to said barrel.

5. A connector according to claim 2 wherein said ratchet mechanism includes a collet having a pair of jaws to engage said rod.

6. A connector according to claim 5 wherein said jaws are located in said barrel and biased into engagement with said rod.

7. A connector according to claim 6 wherein said jaws have inclined leading edges that bear against complimentary surfaces in said barrel and bias said jaws into engagement with said rod.

8. A connector according to claim 7 wherein said jaws are resiliently biased against said complimentary surfaces.

9. A connector according to claim 5 wherein inter-engaging surfaces of said rod and said jaws are threaded, whereby rotation of said rod relative to said jaws causes axial displacement of said rod relative to said barrel.

10. A connector according to claim 9 wherein said adjustable abutment is a nut threaded onto said rod.

11. A connector according to claim 10 wherein said jaws have inclined leading edges that bear against complimentary surfaces in said barrel to bias said jaws in to engagement with said rod upon relative movement between said rod and said barrel in said opposite direction.

12. A connector according to claim 11 wherein a spring acts between said barrel and said jaws to maintain said leading edges in engagement with said complimentary surfaces.

13. A connector according to claim 12 wherein said spring is located within said barrel.

14. A connector according to claim 1 wherein each of said members includes a plate for connection to respective ones of said components.

15. A connector according to claim 14 wherein said members telescope within one another, and said adjustable abutment and said ratchet mechanism are located at axially spaced locations.

16. A connector according to claim 15 wherein one of said members includes a rod and the other includes a barrel to receive said rod, said ratchet mechanism being located within said barrel.

17. A connector according to claim 16 wherein said adjustable abutment is a nut threaded on to said rod and abutting an end face of said barrel.

* * * * *